United States Patent [19]

O'Meara

[11] Patent Number: 4,867,326

[45] Date of Patent: Sep. 19, 1989

[54] CHILD RESISTANT CAP AND TUBE ASSEMBLY

[75] Inventor: John R. O'Meara, Jamesburg, N.J.

[73] Assignee: CP Packaging, Jamesburg, N.J.

[21] Appl. No.: 236,191

[22] Filed: Aug. 25, 1988

[51] Int. Cl.[4] ..... B65D 51/24

[52] U.S. Cl. ..... 215/250; 81/3.48; 215/226; 215/253; 222/83; 220/278

[58] Field of Search ..... 220/278; 215/226, 250, 215/253; 222/83, 81; 81/3.48, 3.47

[56] References Cited

U.S. PATENT DOCUMENTS

| | | | |
|---|---|---|---|
| 2,771,218 | 11/1956 | Henderson | 222/83 |
| 3,454,196 | 7/1969 | Hazard | 222/83 |
| 4,340,147 | 7/1982 | McIntosh | 215/226 |
| 4,678,098 | 7/1987 | Oka | 222/83 |

FOREIGN PATENT DOCUMENTS

| | | | |
|---|---|---|---|
| 476608 | 9/1969 | Switzerland | 220/278 |

*Primary Examiner*—Donald F. Norton

*Attorney, Agent, or Firm*—Eugene E. Renz, Jr.

[57] ABSTRACT

A child resistant cap and tube assembly with a tube for containing a product and having an end portion terminating in an axially centered open surface at its outer perimeter and having a recessed thin wall below the surface to seal the tube. The tube has a second surface of interference to axial movement on the end which is a predetermined distance from the perimeter. A cap is also provided, having a central axis for alignment with the tube and sized to slidably engage the end portion. The cap also has a resistance surface for engaging the surface of interference at a predetermined distance to locate the cap on the end portion at a first position to protect the recessed thin wall. The cap has an axially centered puncture means positioned inside said cap to puncture the recessed thin wall upon movement of the cap to a second position for opening the tube. Finally, the surface of interference and the resistance surface are positioned to cooperatively resist movement of the cap to the second position with a force sufficient to prevent inadvertent movement to that second position.

15 Claims, 2 Drawing Sheets

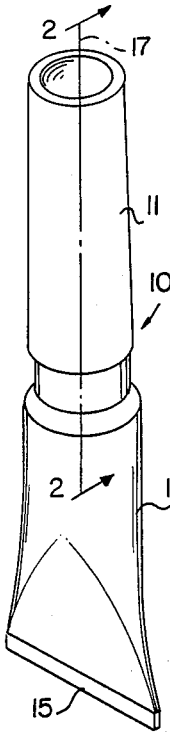
FIG. 1
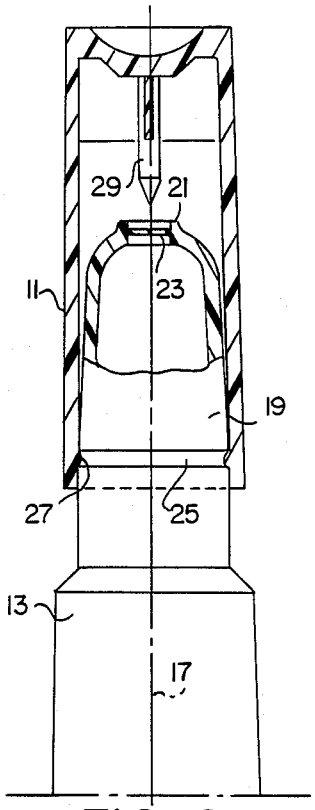
FIG. 2
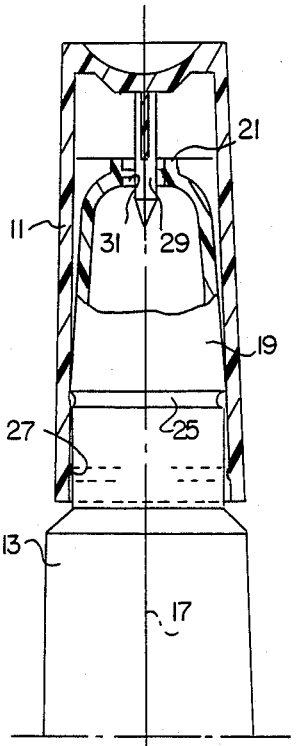
FIG. 3
FIG. 4
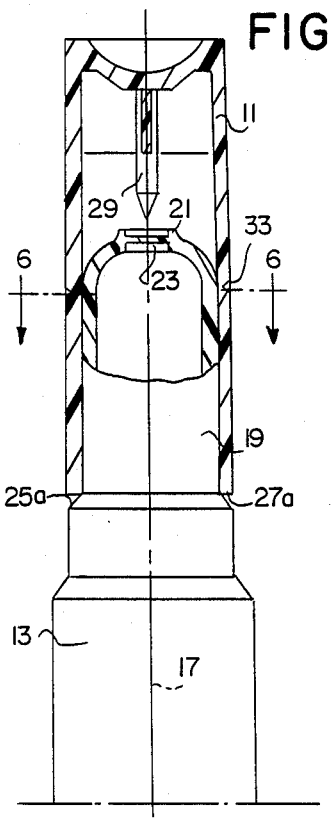
FIG. 5
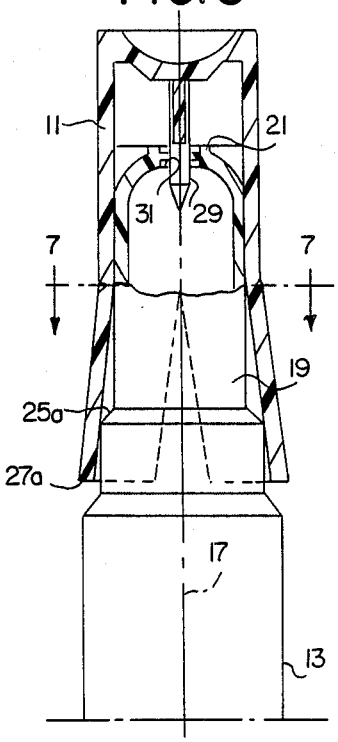
FIG. 6
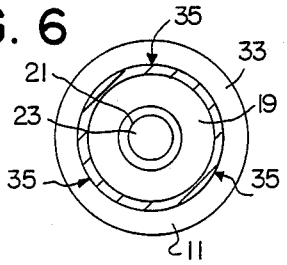
FIG. 7
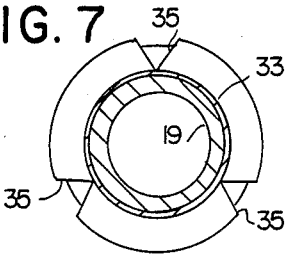

CHILD RESISTANT CAP AND TUBE ASSEMBLY

FIELD OF THE INVENTION

This invention relates to child resistant cap and tube assemblies, and particularly to those assemblies which are designed for tubes which contain a unitary dose of medicine, vitamins, eye drops, or other pharmaceutically related products. The cap and tube assembly is also useful for products which are designed to contain a small number of doses, such as eye drops. The device is particularly suitable for unit dose sterile medicaments which do not have a preservative in the product as a protection to exposure to the atmosphere.

BACKGROUND OF THE INVENTION

Child resistant cap and tube assemblies which carry medicines, vitamins and the like have become of great interest to the pharmaceutical industry. It is a growing need that container assemblies should be difficult for children to open, particularly accidentally. Also, increased interest is being shown in tube and cap assemblies which cannot be opened by happenstance but which require a specific and positive step to be taken in order to have access to the contents. This is particularly true when medicines, vitamins and topical treatments such as eye drops are contained in tubes.

In actual practice, the assurance that the tube has not been opened prematurely is sometimes more important than the need to prevent undesirable tampering, such as by a child. This is because the contents, while valuable, are not dangerous and it is more important to know whether or not the contents have been contaminated or, perhaps, partially spilled. Particularly when unit doses are provided in a tube, it is important that the full quantity of medicine which has been prescribed be delivered to the patient.

Prior art devices have not yet produced a practical child resistant cap and tube assembly. One prior art design includes a three piece construction in which a tube body contains a plug attached to a portion of the main body of the tube. The wall of the tube has been weakened sufficiently to permit the plug to be torn from the tube. A cap portion is designed so that one end might be fitted over the tube having the plug, thereby protecting the plug and tube. The other end is then designed to interact with the plug in a twisting manner to remove the plug by rupturing the thin wall of the tube to which the plug is attached. This design has not been effective, however, because of the additional concern caused by the existence of the plug and the need for safe and reliable disposal of the plug.

Accordingly, it is still important that a new and improved cap and tube assembly which is child-resistant and suitable for a high reliability pass/fail inspection would be of great value to the pharmaceutical industry. This product would therefore also be of great value to the children and other consumers of these products. It would be of particular value if a device could be provided which permits easy inspection of unit dose sterile medicaments which do not contain preservatives in the product, to avoid use of spoiled or contaminated products.

SUMMARY OF THE INVENTION

It has now been discovered that the above and other objects of the present invention may be accomplished in the following manner. Specifically, a child-resistant cap and tube assembly has been discovered which comprises the following components. A tube is provided for containing a product, and has one end portion which terminates in an axially centered first opened surface at the outer perimeter of the end portion. Recessed below the surface of the end portion is a thin wall which seals the tube. The other end of the tube is crimped or closed after filling, using a conventional method. The tube also has a second surface, called a surface of interference, which operates to interfere with axial movement on the end portion. The surface of interference is positioned a predetermined distance from the perimeter of the tube end.

Also provided is a cap which has a central axis for alignment with the tube and is sized to slidably engage the end portion. The cap has a resistance surface which is designed to engage the surface of interference on the tube at a predetermined distance, to thereby locate the cap on the end portion of the tube at a first position. This first position will protect the recessed thin wall so that the cap functions in the normal manner of a cap on a tube.

The cap also includes an axially centered puncture means positioned inside the cap which is adapted to puncture the recessed thin wall of the tube upon movement of the cap to a second position on the end portion of the tube. This puncturing of the thin wall permits access to the contents in the tube. The surface of interference and the resistance surface cooperatively resist movement of the cap to this second position of puncturing. A force is necessary to overcome this resistance. The amount of the force is sufficient to prevent inadvertent movement of the cap to the second position on the tube end.

Typically, the surface of interference and the resistance surface may comprise a shoulder on the tube which interacts with the end of the tube. Alternatively, a ridge and groove may be employed, with the ridge being located on either the tube or the cap and the groove located on the other component of the assembly. Additionally, the cap and tube assembly may be press fit, or a threaded closure may be employed. Particularly preferred is a three faced probe to be used as a puncture means so that the thin wall will bend back and will not be disconnected from the tube.

BRIEF DESCRIPTION OF THE DRAWINGS

These and other objects of the present invention and the various features and details of the operation and construction thereof are hereinafter more fully set forth with reference to the accompanying drawings, wherein:

FIG. 1 is an enlarged perspective view showing a combination of a cap and tube assembly before access to the contents of the tube;

FIG. 2 is an enlarged section view of the assembly of FIG. 1, taken along lines 2—2, in which a first embodiment is shown;

FIG. 3 is an enlarged sectional view similar to FIG. 2 but with the cap moved to a position permitting access to the contents of the tube;

FIG. 4 is an enlarged sectional view of a cap and tube assembly of the type shown in FIG. 1, in which a second embodiment is shown;

FIG. 5 is an enlarged sectional view similar to FIG. 4 with the cap moved to a position permitting access to the contents of the tube;

FIG. 6 is a sectional view taken along line 6—6 of FIG. 4;

FIG. 7 is a sectional view taken along line 7—7 of FIG. 5;

DETAILED DESCRIPTION OF THE PREFERRED EMBODIMENT

Figure 8:
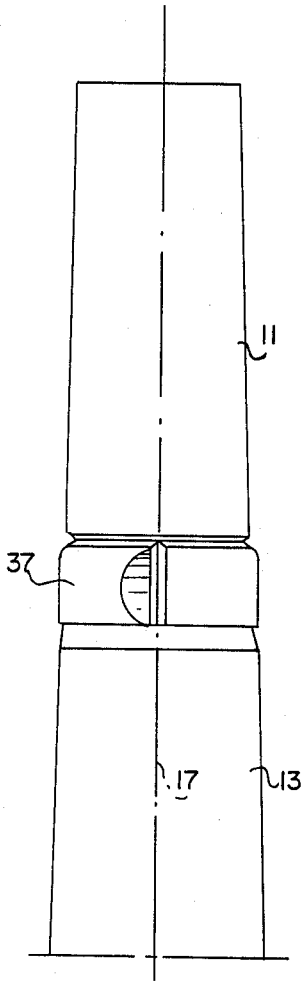
FIG. 8 is an enlarged side elevational view of another cap and tube assembly, showing a tamper evident feature.

As shown in the drawings, the assembly 10 has a cap 11 and tube 13 which are combined so that the cap engages one end of the tube. The tube is filled typically with a small quantity of product after the cap and tube assembly has been manufactured and sterilized, if necessary. The contents are placed in the tube and the other end 15, away from the cap, is then sealed by crimping, heat sealing or other conventional methods for permanently closing that end of the tube. In a preferred embodiment, cap 11 is clear or transparent so that the user can see if the package has been punctured.

The tube and cap are centered about a central axis 17 such that the cap 11 fits over the end portion 19 of the tube 13. The end portion 19 terminates in an axially centered first opening surface 21 which is located at the outer perimeter of the tube 13. This opened surface 21 has a recessed thin wall 23 which is set back from the perimeter and protected from damage by the outer perimeter 21.

Also associated with the tube 13 is a second surface of interference 25 which provides interference to axial movement on the end 19. This surface of interference 25 is positioned a predetermined distance from the perimeter 21 of the tube 19. This surface of interference may be a groove 25 as shown in FIGS. 2 and 3 or it might be a shoulder **25*a* as shown in FIGS. 4 and 5 as well as in FIGS. 9 and 10. This shoulder embodiment 25*a*** is much simpler to construct and is a preferred embodiment.

Figure 9:
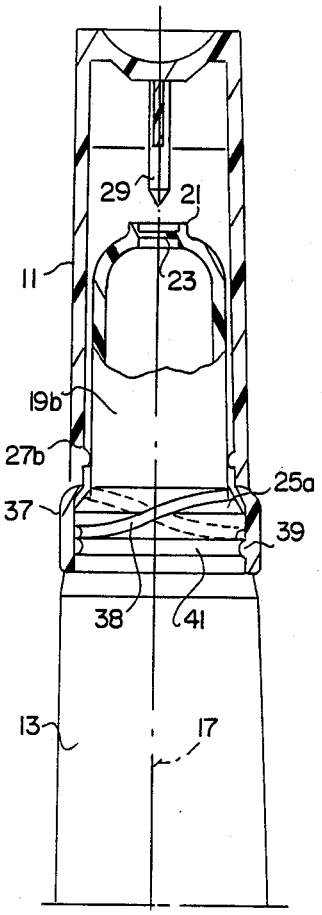
FIG. 9 is an enlarged fragmentary sectional view of the device shown in FIG. 8.
Figure 10:
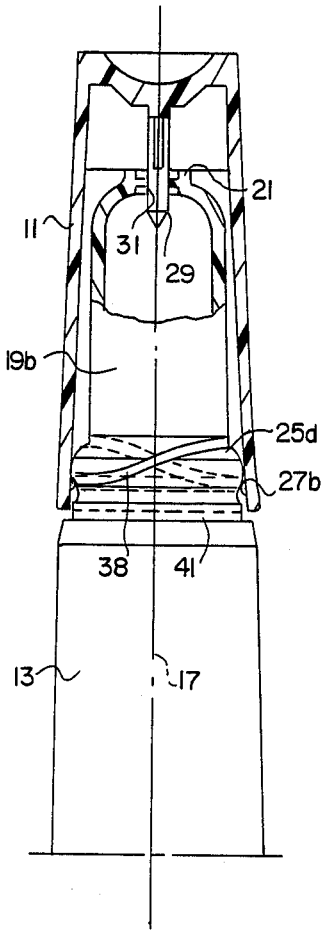
FIG. 10 is an enlarged fragmentary sectional view similar to FIG. 9 but showing the cap moved to a position permitting access to the contents of the tube.

Associated with the surface of interference 25 is a resistance surface 27 which is part of the cap 11. In FIGS. 2 and 3, the resistance surface 27 is in the form of a ridge which fits into groove 25. In FIGS. 4 and 5, the surface of resistance **27*a* is located at the end of the cap 11 as will be described hereinafter. In yet another embodiment, the surface of resistance can be a bead 27*b* as shown in FIGS. 9 and 10. In all embodiments, either 25 of 27** can be the ridge and the other can be the groove, depending on ease of manufacture.

Also associated with the cap 11 is a puncture means 29 which is shown as a sharp pointed extension on the inside of the cap and which is suitable for piercing the thin wall 23 to permit access to the contents of the tube 13. In a preferred embodiment, the puncture means 29 is of smaller diameter than the thin wall 23 and the opening at end 21. Upon movement of the cap 11 axially down on the tube 13, the puncture means 29 pierces the center of thin wall 23, causing portions of the thin wall to curl as shown at reference numeral 31. The size and shape of the puncture member 29 is such that it will not go to the edge of thin wall 23, thereby causing the thin wall 23 to peel back but not causing it to be sheared from its position proximate the end 21 of tube end 19.

There are two particular advantages in this embodiment. First, the thin wall 23 is located below the open surface of the outer perimeter 21, so that nothing protrudes which could damage the patient. This is of particular concern if the cap and tube assembly is used for eye drops, so that the puncturing step does not provide any danger that the eye might be scratched. In addition, the size and shape of the puncturing means causes the thin wall 21 to peel back, but not break off. This non-breaking feature is essential to prevent plastic pieces falling into the tube. Additionally, when a special drop size is desired, such as in diagnostic packages, the member 29 can be specifically sized so that an accurately sized hole is made in wall 21. A different size for member 29 will produce a different hole size in wall 21, allowing selectivity in the drop size.

The operation of the device shown in FIGS. 2 and 3 is simple and yet it is extremely effective in protecting the contents of the tube until a decision is made to access the contents for use by a patient or other consumer. This cap 11 is held on the end 19 of the tube 13 by the surface of interference and resistance surface, which in this embodiment is a groove 25 and a ridge 27. The location of the groove 25 and ridge 27 positions the cap and tube to protect the recessed thin wall 23. The depth of the groove 25 and the height of the ridge 27 can be selected to provide a force of resistance to movement of the cap 11 which is sufficient to prevent inadvertent movement of the cap further toward the tube 13. When this force is overcome, by the application of intentional pressure, the ridge 27 comes out of the groove 25 and slides along the end portion 19 of the tube 13. As the ridge 27 slides, obviously the entire cap slides and the puncture means 29 contacts and ruptures the thin wall 23 as shown in FIG. 3. The thin wall 23 peels back into a split wall 31 which now permits access to the contents of the tube 13. Because the puncture means 29 is smaller than the opening 21, the torn portions of the thin wall 31 do not break off and fall into the interior of the tube 21. As the thin wall 23 is recessed from the end portion 21, even after withdrawing the cap 11 and the puncture means 29, there is no portion of the thin wall 23 which extends above the first open surface or end outer perimeter 21 of the tube end 19.

In FIGS. 4 through 7, a second preferred embodiment is shown in which the cap and tube assembly function in the same manner as previously described to protect the contents of the tube. As shown in FIG. 4, the cap 11 is snugly fit on the end 19 of tube 13. A shoulder **25*a* prevents movement of the end 27*a* of the tube 11 beyond the first position which is defined by those two elements 25*a* and 27*a* which form a surface of interference and a resistance surface as previously described. The cap, because it is snugly fit on the end portion 19, functions as it is intended to as a cap. The force required to overcome the cooperative resistance between the surface of interference and the resistance surface, 25*a* and 27*a*, is sufficient to prevent inadvertent access to the contents of the tube 13**.

In FIG. 5, the cap 11 is moved with sufficient force to overcome the resistance caused by the junction of shoulder **25*a* and tip 27*a*. In some instances, the material from which the cap 11 is manufactured, such as a plastic material, will have sufficient elasticity to permit the cap to slide over the shoulder 25*a*. In cases where the cap is made of a more rigid or less elastic material, or when the resistance force caused by the junction of the shoulder 25*a* and the end point 27*a*** is intentionally designed to be high, the features shown in FIG. 5 can be employed. Specifically, a groove 33 is provided in the wall of the tube 11 along with a plurality of axially extending cuts 35. First, the cap 11 is moved towards the tube 13, overcoming the force of a resistance caused by the shoulder 25*a* and the end 27*a*. Once the end 27*a* has moved beyond the shoulder 25*a*, the force causing the movement of the cap 11 and the puncture means 29 to enter through the thin wall 23 is sufficient to cause the wall of the tube 11 to bend at the groove 33 to that portions of the tube 11 separate along line or cut 35 to flare out. The portion of the cap 11 which is above the groove 33 maintains a snug fit and, with appropriate tolerances, is sufficient to keep the cap and tube assembly functioning after the thin wall 23 has been punctured. As shown in FIG. 6, the cuts 35 do not interfere with the operation of the cap and tube assembly prior to puncturing the thin wall 23. Once the cap has been moved to the position shown in FIG. 5, the wall of the cap 11 flares out so that the cuts 35 become significantly larger.

As shown in FIGS. 8,9 and 10, another embodiment can be used employing the principals of the present invention. In this design, a tamper-evident pull tab 37 is added at the bottom of the cap to additional prevent the cap from being pushed down. This tamper-evident tab 37 can be pulled off and thereby allow the cap and tube assembly to function as previously described. Prior to removal of tab 37, the cap 11 cannot be moved toward tube 13. Additionally, shown in FIGS. 9 and 10, is an embodiment in which the cap 11 is prevented from movement to the tube 13 initially by the tamper-evident tab 37. Once the tab 37 has been removed, a ridge 27*b*, which is positioned in a groove 25 maintains the relative relationship between the cap 11 and the tube 13. Upon application 1 of force by the cap 11 toward the tube 13, the raised portion 27*b* encounters shoulder 25*a* which offers a resistance to movement to the second position by a force sufficient to prevent inadvertent movement which would cause the puncture means 29 to puncture the thin wall 23.

The particular feature show in FIGS. 9 and 10 includes the use of a ridge 39 on tamper-evident tab 37. Ridge 39 fits into the thread 41 that has been formed in the tube end 19*a*. When the tamper-evident tab 37 is removed, and the cap 11 is moved to puncture the thin wall 23 with the puncture means 29, as the ridge 27*b* is forced over the shoulder 25*a*, it engages threads 41, so that the cap 11 can be screwed onto the tube 13 using the combination of the rib 27*b* and the threads 41. Once the puncture means 29 has punctured the thin wall 23, the cap is merely unscrewed for access to the contents of the tube 17. In this feature, it is possible to reassemble the cap by rescrewing the ridge 27*b* in threads 41 if all of the contents of the tube 13 are not used in the first treatment.

While particular embodiments of the invention have been illustrated and described herein, it is not intended to limit the invention, and changes and modifications may be made therein within the scope of the following claims.

What is claimed is:

1. A child resistant cap and tube assembly, comprising:

a tube for containing a product and having an end portion with a thin wall section puncturable to provide a discharge opening;

said tube further having a surface of interferences to axial movement on said end portion;

a cap having a central axis for alignment with said tube and sized to slidably engage said end portion;

an axially centered puncture means positioned inside said cap normally spaced from said thin wall section in a first position and operable to puncture said recessed thin wall upon movement of said cap to a second position for opening said discharge opening;

said surface of interference and said resistance surface cooperatively resisting movement of said cap to said second position with a force sufficient to prevent inadvertent movement to said second position;

said end portion of said tube and said cap being mutually tapered to provide a snug fit therebetween; and said cap being made from a material capable of expanding under force to permit movement of said cap to said second position on said tube upon application of said sufficient force.

2. The assembly of claim 1 wherein said surface of interference comprises a shoulder on said tube end and said resistance surface comprises the end of the side wall of the cap.

3. The assembly of claim 1 wherein said puncture means comprises a sharp pointed means for tearing said thin wall along a plurality of lines radially from said axis.

4. The assembly of claim 3 wherein said puncture means is sized to puncture said thin wall without contacting the edge of said thin wall.

5. A child resistant cap and tube assembly, comprising:

a tube for containing a product having an end portion with a thin wall section puncturable to provide a discharge opening;

said tube further having a surface of interference to axial movement on said end, and positioned a predetermined distance from said perimeter;

a cap having a central axis for alignment with said tube and sized to slidably engage said end portion;

said cap having a resistance surface for engaging said surface of interference at a predetermined distance to locate said cap on said end portion at a first position to protect said recessed thin wall;

said cap having an axially centered puncture means positioned inside said cap to puncture said recessed thin wall upon movement of said cap to a second position for opening said tube;

said surface of interference and said resistance surface cooperatively resisting movement of said cap to said second position with a force sufficient to prevent inadvertent movement to said second position, said surface of interference and resistance surface comprise a ring and groove, such that the ring is provided on either said cap or said tube and the groove is provided on the other of said cap or said tube and said end portions of said tube and said cap are mutually tapered to provide a snug fit therebetween.

6. The assembly of claim 5 wherein said cap is made from a material capable of expanding under force to permit movement of said cap to said second position on said tube upon application of said sufficient force.

7. The assembly of claim 5, wherein said puncture means comprises a sharp pointed means for tearing said thin wall along a plurality of scorelines extending radially from the central axis of the cap.

8. The assembly of claim 7, wherein said puncture means is sized to puncture said thin wall section without contacting the edge of said thin wall.

9. A child resistant cap and tube assembly, comprising;

a tube for containing a product and having an end portion with a recessed thin wall section puncturable to provide a discharge opening;

said tube further having a surface of interference to axial movement on said end;

a cap having a central axis for alignment with said tube and sized to slidably engage said end portion;

said cap having a resistance surface for engaging said surface of interference at a predetermined distance to locate said cap on said end portion at a first position to protect said recessed thin wall;

said cap having an axially centered puncture means positioned inside said cap to puncture said recessed thin wall upon movement of said cap to a second position for opening said tube;

said surface of interference and said resistance surface cooperatively resisting movement of said cap to said second position with a force sufficient to prevent inadvertent movement to said second position;

said surface of interference and resistance surface comprising a ring and groove located in a common horizontal plane extending transversely to said central axis, such that the ring is provided on either said cap or said tube and the groove is provided on the other said cap or said tube.

10. A child resistant cap and tube assembly, comprising;

a tube for containing a product and having an end portion with a recessed thin wall section puncturable to define a discharge opening;

said tube further having a surface of interference to axial movement on said end;

a cap having a central axis for alignment with said tube and sized to slidably engage said end portion;

said cap having a resistance surface for engaging said surface of interference at a predetermined distance to locate said cap on said end portion at a first position to protect said recessed thin wall;

said cap having an axially centered puncture means positioned inside said cap to puncture said recessed thin wall upon movement of said cap to a second position for opening said tube;

said surface of interference and said resistance surface cooperatively resisting movement of said cap to said second position with a force sufficient to prevent inadvertent movement to said second position;

said cap end including a threaded portion positioned to accept said cap in said second position upon rotation of said cap, and said surface of interference and resistance surface comprising a complementary ring and groove on the cap and tube.

11. A child resistant cap and tube assembly, comprising;

a tube for containing a product and having an end portion with a recessed thin wall section puncturable to provide a discharge opening;

said tube further having a surface of interference to axial movement on said end, and positioned a predetermined distance from said perimeter;

a cap having a central axis for alignment with said tube and sized to slidably engage said end portion;

said cap having a resistance surface for engaging said surface of interference from the end of the side wall of the cap and located at a predetermined distance to locate said cap on said end portion at a first position to protect said recessed thin wall;

said cap having an axially centered puncture means positioned inside said cap to puncture said recessed thin wall upon movement of said cap to a second position for opening said tube;

said surface of interference and said resistance surface cooperatively resisting movement of said cap to said second position with a force sufficient to prevent inadvertent movement to said second position, and said end portion of said tube and said cap are mutually tapered to provide a snug fit therebetween, said cap being made from a material capable of expanding under force to permit movement of said cap to said second position on said tube upon application of said sufficient force.

12. The assembly of claim 11, wherein said puncture means comprises a sharp pointed means for tearing said thin wall along a plurality of scorelines extending radially from the central axis of the cap.

13. The assembly of claim 12 wherein said puncture means is sized to puncture said thin wall section.

14. A cap and tube assembly comprising an elongated tube having a thin wall section defining a punctural diaphragm at one end to provide a discharge opening;

an open-ended cap having a puncturing element engageable with said diaphragm, the cap and tube end portion having complementary interengaging surfaces normally providing a friction fit of said cap on the tube end portion, means defining an offset abutment shoulder on the tube end portion which the lower terminal edge of the cap normally confronts and abuts, means defining a scoring in said cap of a configuration including circumferentially spaced, axially extending scorelines running to the lower terminal edge of the cap, actuation of said cap in one axial direction causing said piercing element to pierce said diaphragm whereby said lower terminal edge engages the beveled shoulder to affect separation of the axial scorelines providing visual indicia that the piercing element has punctured the diaphragm.

15. A cap and tube assembly comprising a tube having an end portion with a thin wall section puncturable to provide a discharge opening, a cap fitting over the end portion and having a piercing member aligned with the diaphragm, a tear band connected to the lower terminal edge of the cap by a fracturable scoreline, means defining axially spaced, circumferentially extending beads on the lower terminal edge of the cap and the lower terminal edge of the tear band, means defining a thread on the tube adjacent the lower end of the end portion engageable by said beads to normally hold the cap in place, said tear band removable to permit actuation of said cap to pierce the diaphragm.

* * * * *